US007584731B2

(12) United States Patent
Bachmann et al.

(10) Patent No.: US 7,584,731 B2
(45) Date of Patent: Sep. 8, 2009

(54) CAMSHAFT ADJUSTER FOR AN INTERNAL COMBUSTION ENGINE

(75) Inventors: Josef Bachmann, Obersinn (DE); Rolf Schwarze, Aalen (DE)

(73) Assignee: GKN Sinter Metals Holding GmbH, Radevormwald (DE)

( * ) Notice: Subject to any disclaimer, the term of this patent is extended or adjusted under 35 U.S.C. 154(b) by 299 days.

(21) Appl. No.: 11/692,607

(22) Filed: Mar. 28, 2007

(65) Prior Publication Data

US 2007/0169733 A1 Jul. 26, 2007

Related U.S. Application Data

(63) Continuation of application No. PCT/EP2005/008669, filed on Aug. 10, 2005.

(30) Foreign Application Priority Data

Sep. 29, 2004 (DE) ..... 10 2004 047 817

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 160; 475/331
See application file for complete search history.

(56) References Cited

U.S. PATENT DOCUMENTS 6,386,165 B1 * 5/2002 Eisenmann et al. ..... 123/90.17

FOREIGN PATENT DOCUMENTS

| | | |
|---|---|---|
| DE | 100 20 120 A1 | 10/2001 |
| DE | 100 54 796 A1 | 6/2002 |
| DE | 101 09 837 A1 | 9/2002 |
| JP | 05296011 | 11/1993 |
| JP | 2000204915 | 7/2000 |
| JP | 2002332812 | 11/2002 |

* cited by examiner

*Primary Examiner*—Ching Chang
(74) *Attorney, Agent, or Firm*—Quarles & Brady LLP

(57) ABSTRACT

A camshaft adjuster for an internal combustion engine comprises a stator having inwardly projecting stator vanes, which are distributed over the periphery of the stator and which have at least one stator vane accommodating pocket located in the stator. This stator vane accommodating pocket is open toward the interior and a stator vane planet gear is mounted inside the stator vane accommodating pocket. A rotor is mounted inside the stator and comprises rotor vanes having at least one rotor vane accommodating pocket open toward the exterior, inside of which a rotor vane planet gear is mounted. The stator vane planet gears mesh with a denticulated segment located on the outer periphery of the rotor between each of the rotor vanes, and the rotor vane planet gears mesh with a denticulated segment located on the inner periphery of the stator between each of the stator vanes.

7 Claims, 3 Drawing Sheets

CAMSHAFT ADJUSTER FOR AN INTERNAL COMBUSTION ENGINE

CROSS-REFERENCE TO RELATED APPLICATIONS

This application is a continuation of prior PCT Application No. PCT/EP2005/008669, filed Aug. 10, 2005, which claims priority of German Application No. 102004047817.1-13, filed on Sep. 29, 2004.

FIELD OF THE INVENTION

The invention relates to a camshaft adjuster for internal combustion engines.

BACKGROUND OF THE INVENTION

Camshaft adjusters of the aforementioned type serve to make possible valve control which is variable or as optimized as possible. They offer the possibility of adjusting the phase angle of the valve control continuously and in a controlled manner. For this, a camshaft adjuster is connected to the respective camshaft in a manner that it is fixed against turning and force-locking.

Depending on the presetting of monitoring and control electronics, a turning motion is transmitted to the camshaft and thereby a respective desired setting of the camshaft relative to the crankshaft of the internal combustion engine is preset.

Customary camshaft adjusters are usually driven hydraulically. The oil pressure needed to adjust the camshaft is obtained from the lubricant oil circuit associated with the internal combustion engine in question. In so doing, there is the problem that, precisely in the motor start phase critical for exhaust gas, the camshaft is still not in the desired position relative to the crankshaft.

The current generation of camshaft adjusters which change the angular position of the camshaft continuously is represented by systems which are constructed according to the oscillating motor principle.

The advantages of systems of this type are the continuous adjustment of the camshaft and the compact and economical mode of construction. An economical process for the production of camshaft adjusters is the sintering process, which is also suitable for mass production.

The aforementioned systems are provided, via the oil pump, with pressure oil from the lubricant oil circuit, where, during so-called "hot idling," these systems also have to function at oil temperatures of 150° C. and pressures of <0.5 bar at the idling speed of the motor. Thermal effects which can occur, due to the temperatures of at most 150° C. reached in the operation of the motor, must be taken into account in the design of the component size and tolerances.

From DE 100 62 981 A1 a camshaft adjustment device operating according to the so-called vane-cell principle is known. A drive wheel comprises a cavity formed by a peripheral wall and two side walls, where in said cavity at least one hydraulic working space is formed by at least two bounding walls. A vane extending in the hydraulic working space divides the hydraulic working space into two hydraulic pressure chambers. Gaps between a head of a pressurizing medium distributor and an opening of one side wall of the drive wheel and/or between the lateral surface and an opening of the other side wall of the drive wheel are sealed, by wear-resistant sealing means, against leaks of pressurizing medium.

DE 198 08 619 A1 describes a locking device for a vane-cell adjustment device. There a mechanical coupling between a vane wheel and a drive wheel can be produced by at least one vane of the vane wheel, where that vane is movable in the axial direction and is formed as a vane wheel pivoting element and at the same time as a locking element.

From DE 100 20 120 A1 a vane-cell adjustment device is known in which, between a pivotable vane wheel and a drive wheel, radial gaps are provided which are formed to be enlarged, while the sealing elements are formed as sealing strips which can be pivoted in both turning directions of the pivotable vane wheel and which can be pivoted with the pressure of the hydraulic pressurizing medium against the respective counterface on the drive wheel or on the pivotable vane wheel.

In the vane-cell adjustment device of DE 101 09 837 A1 a drive unit is mounted so that it can be pivoted over several radial mounting points on a drive unit, where at least the surface of the individual radial mounting segments of the drive unit and the opposing radial mounting segments of the drive unit as well as optionally also the axial contact surfaces between the drive unit and the drive unit are formed with a friction-reducing coating.

From the Patent Abstracts of Japan JP 11013431 a vane-cell adjustment device is known in which, to achieve a compact structure, transmission of the turning is accomplished by means of three pins which engage in corresponding elongated holes in the housing of the vane-cell adjustment device.

It is problematic in camshaft adjusters of this type that, to avoid greater internal leakage in the pressure chambers, narrow tolerances must be adhered to, which can only be adhered to with undesirable expenditure, in particular if components of this type are produced with sintering technology. In production using sintering technology these tolerances can thus only be achieved by corresponding complicated mechanical processing, or via clearly reduced number of pieces. Furthermore, in the case of most camshaft adjusters, locking mechanisms or restoring springs must be built in order to guarantee function during so-called "hot idling."

SUMMARY OF THE INVENTION

The invention provides a camshaft adjuster for internal combustion engines which prevents internal radial leaks and can be produced economically.

In this aspect, the camshaft adjuster has a stator which comprises, distributed over its periphery, stator vanes projecting inwards in the radial direction which comprise at least one mounting pocket which is open in the inward direction and in which a stator vane planet gear is mounted, where, mounted in the stator, there is a rotor which comprises rotor vanes with at least one mounting pocket which is open in the outwards direction and in which a rotor vane planet gear is mounted, where the stator vane planet gear meshes with a denticulated segment disposed on the outer periphery of the rotor between each pair of rotor vanes and the rotor vane planet gear meshes with a denticulated segment disposed on the inner periphery of the stator between each pair of stator vanes.

Internal radial leakages, which arise between the contact points of the stator and the inner rotor in the form of gap losses, must be prevented by the introduction of a sealing element between the inner rotor and the stator, or by narrowed tolerances. The gap losses are prevented by the introduction of a denticulated segment in the form of an outer denticulation between two rotor vanes on the inner rotor and a planet gear mounted in the stator vane, where said planet gear meshes with the denticulated segment of the inner rotor. In addition, a denticulated segment, in the form of an inner denticulation between the stator vanes, is provided on the stator, where, in the rotor vane, a rotor vane planet gear is mounted which meshes with the denticulated segment of the stator.

With a change of the angular position of the inner rotor relative to the stator, the stator planet gear rolls on the denticulated segment of the inner rotor and the rotor vane planetary gear which is mounted in the rotor vane rolls on the denticulated segment of the stator.

In order to avoid faults in engagement, the geometry of the denticulation must be designed so that the denticulation data of the planet gears which are mounted in the rotor vane and in the stator vane are equal. In this way, the production costs are also lowered since in sintering-based production of the rotor vane planet gears and stator planet gears only one tool is used. The adjustment of the inner rotor is done by pressure being increased in a pressure chamber, where depending on the pressurized pressure chamber the pressure is against the inner rotor vane and turns it accordingly. Due to the oil pressure in the pressure chamber, the stator vane planet gear which meshes with the denticulated segment of the inner rotor is pressurized, where due to this pressurization the tooth points of the stator vane planet gear are pressed against the wall of the mounting pocket in the stator vane and the tooth flanks of the stator vane planet gear are pressed against the tooth flanks of the denticulated segment of the inner rotor.

Due to the pressing of the tooth points and tooth flanks, large sealing surfaces arise which separate the pressure chambers in the radial direction absolutely tightly from the pressureless chamber. Thereby radial sealing of the camshaft adjuster is enabled.

In an advantageous development of the invention it is provided that the stator comprises at least two stator vanes and the rotor comprises at least two rotor vanes. In a further advantageous development it is provided that the stator comprises three stator vanes and the rotor comprises three rotor vanes. In an also advantageous development of the invention it is provided that the stator comprises four stator vanes and the rotor comprises four rotor vanes. Known camshaft adjusters customarily comprise four stator vanes and four rotor vanes, due to which the possible turning angles of the camshaft are limited by considerations of construction. A reduction of the number of stator vanes and rotor vanes to two or three vanes leads to the result that, on the one hand, larger turning angles can be realized and, on the other hand, the camshaft adjuster becomes lighter and there is a lower mass for moving parts. From the standpoint of construction more than four vanes are also possible.

In a particularly advantageous development of the invention it is provided that the stator, the inner rotor, and/or the planet gears consist of sintered metal. Using sintering technology, these parts can be manufactured with greater tolerances without the radial sealing being impaired. Furthermore, the sensitivity to contaminated oil is low. An additional advantage of the relatively large manufacturing tolerances is the possibility of using materials other than sintered aluminum or plastic. It is advantageous if the rotor, the stator, and the planet gears have approximately equal coefficients of thermal expansion so that these components can be paired with one another. With approximately equal coefficients of thermal expansion it is possible, for example, to use a rotor and stator of sintered steel and the planet gears of plastic (Duroplast). In this way, in particular, a reduction of the noise results with the pairing of sintered steel/plastic.

BRIEF DESCRIPTION OF THE DRAWINGS

Additional features, advantages, and advantageous developments of the invention follow from the claims as well as from the following description of the invention with the aid of the accompanying drawings. These show in FIG. 1, a section through the camshaft adjuster according to the invention and comprising four stator and rotor vanes;

FIG. 2, the detail "X" according to FIG. 1; and in

DETAILED DESCRIPTION OF THE PREFERRED EMBODIMENT

Figure 1:
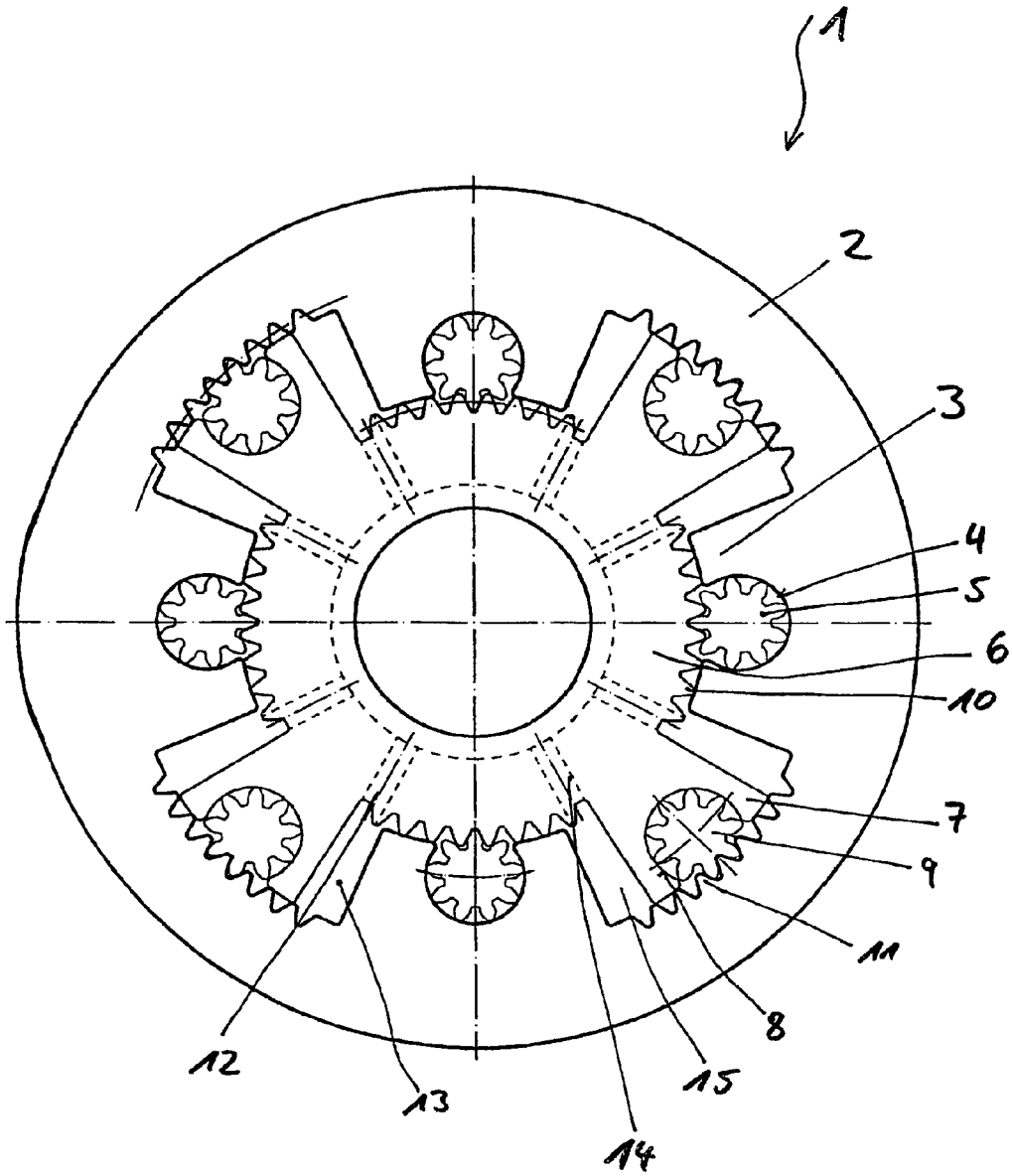

FIG. 1 shows a camshaft adjuster 1 for an unrepresented internal combustion engine with a stator 2 which comprises, distributed over its periphery, stator vanes 3 projecting inwards in the radial direction. Each of the stator vanes 3 comprises a mounting pocket 4 which is open in the inward direction and in which a stator vane planet gear 5 is mounted. Mounted in the stator 2 is a rotor 6 which comprises rotor vanes 7. Each rotor vane 7 comprises a mounting pocket 8 which is open in the outwards direction and in which a rotor vane planet gear 9 is mounted.

Each of the stator vanes 3 projects inwards in the radial direction into the spaces between the two rotor vanes 7. The same holds for the rotor vanes 7, each of which projects cleanly into the intervening space. Thus it follows that the rotor 6 is formed to have approximately the form of a star.

The stator vane planet gear 5 disposed in the stator vane 3 meshes with a denticulated segment 10 disposed on the outer periphery of the rotor 6 between each pair of rotor vanes 7. The rotor vane planet gear 9 disposed in the rotor vane 7 meshes with a denticulated segment 11 disposed on the inner periphery of the stator 2 between each pair of stator vanes 3.

Internal radial leakages, which arise between the contact points of the stator 2 and the inner rotor 6 in the form of gap losses, are prevented by the use of the denticulated segment and the planet gears meshing with them.

The adjustment of the rotor 6 is done by pressure in the pressure chamber 13 being increased through the pressure hole 12, or, for the alternative direction of turning, pressure being increased in the pressure chamber 15. Depending on which pressure chamber 13, 15 is pressurized, the pressure is against the rotor vane 7, whereby it is turned accordingly. The stator vane planet gear 5, which meshes with the denticulated segment 10 of the rotor 6, is pressurized by the oil pressure in the pressure chamber 13 or 15, where, due to the pressurization, the tooth points of the stator vane planet gear 5 are pressed against the wall of the mounting pocket 4 in the stator vane and the tooth flanks of the stator vane planet gear 5 are pressed against the tooth flanks of the denticulated segment 10 of the rotor 6. Due to the pressing of the tooth points and the tooth flanks, large sealing surfaces arise, which separate the pressure chambers 13, 15 in the radial direction absolutely tightly from the corresponding pressureless chamber 13, 15 so that a radial sealing of the camshaft adjuster 1 is enabled.

Figure 2:
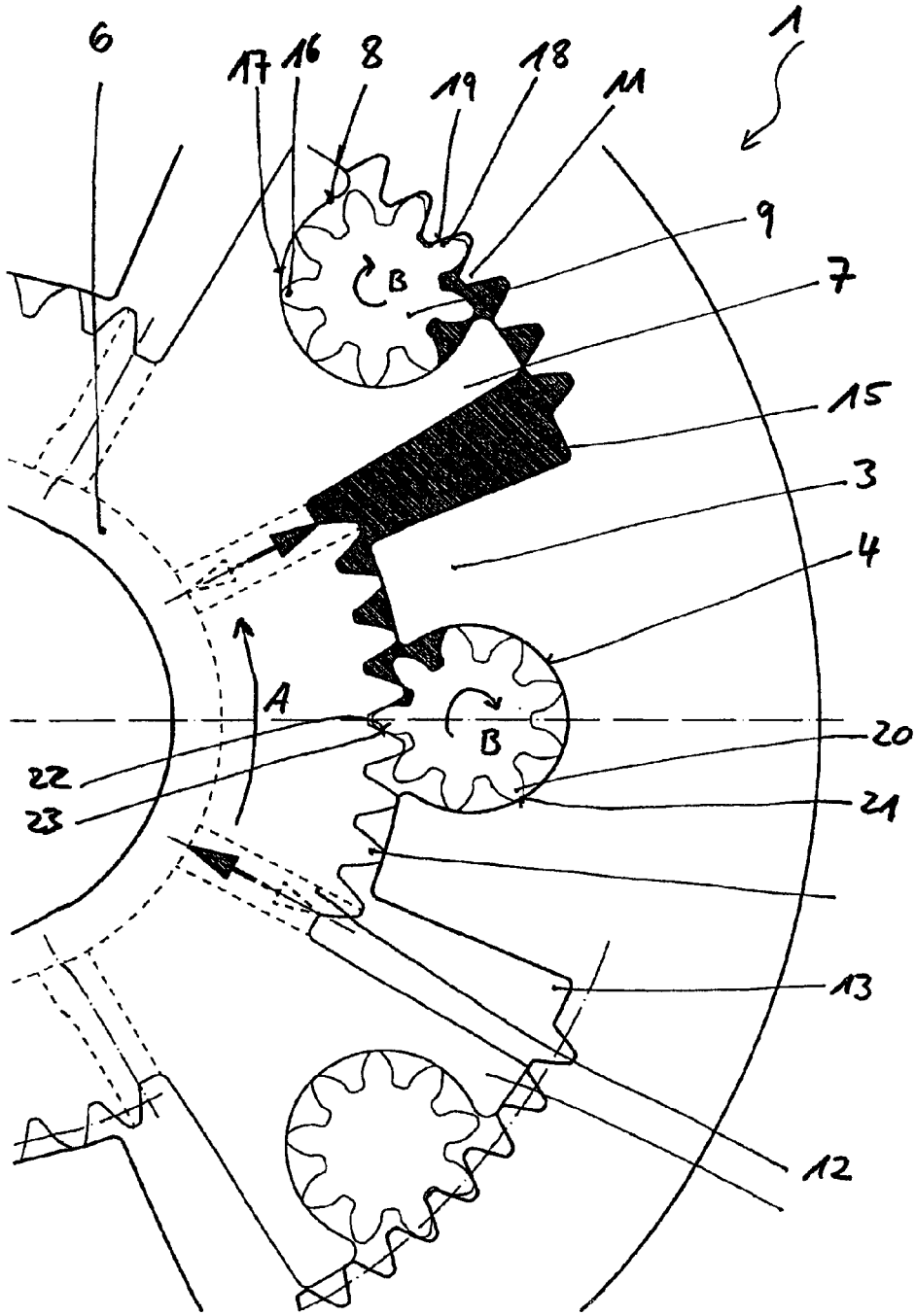

FIG. 2 shows a detail "X" from FIG. 1 with the partially indicated camshaft adjuster 1 which comprises a stator 2 and, mounted in it, a rotor 6, where a state is shown in which the pressure chamber 15 is pressurized with pressure, for example, by means of a hydraulic fluid.

Via the pressure hole 14 the pressure in the pressure chamber 15 is increased, where the pressurized space assumed by the hydraulic fluid is shaded. It has been shown that in addition to the pressure chamber 15, which is formed from the space between the stator vane 3 and the rotor vane 7, additional areas can also be pressurized.

Due to the pressurization of the pressure chamber 15, pressure is exerted on the rotor vane 7, whereby the rotor is turned in the direction of the arrow A. At the same time there is also turning in the direction of the arrow B of the rotor vane planet gear 9 mounted in the mounting pocket 8 in the rotor vane while said planet gear rolls on the denticulated segment 11 disposed between the stator vanes 3. Due to the pressurization, the tooth points 16 of the rotor vane planet gear 9 are pressed against the wall 17 of the mounting pocket 8 in the rotor vane. At the same time, the tooth flanks 18 of the rotor vane planet gear 9 are pressed against the tooth flanks 19 of the denticulated segment 11. Due to the pressing of the tooth points 16 on the wall 17 and the tooth flanks 18 on the tooth flanks 19 of the denticulated segment 11, large sealing surfaces arise, which separate the pressure chamber 15 in the radial direction absolutely tightly from the pressureless chamber 13 so that a radial sealing of the camshaft adjuster 1 is enabled.

This sealing is achieved on one side of the pressure chamber by the sealing in the area of the rotor vane planet gear 9 and on the other side of the chamber in the area of the stator vane planet gear 5. In the stator vane planet gear 5 the tooth points 20 of the stator vane planet gear are accordingly pressed against the wall 21 of the mounting pocket 4 in the stator vane and at the same time the tooth flanks 22 of the stator vane planet gear 5 are pressed against the tooth flanks 23 of the denticulated segment 10.

Figure 3:
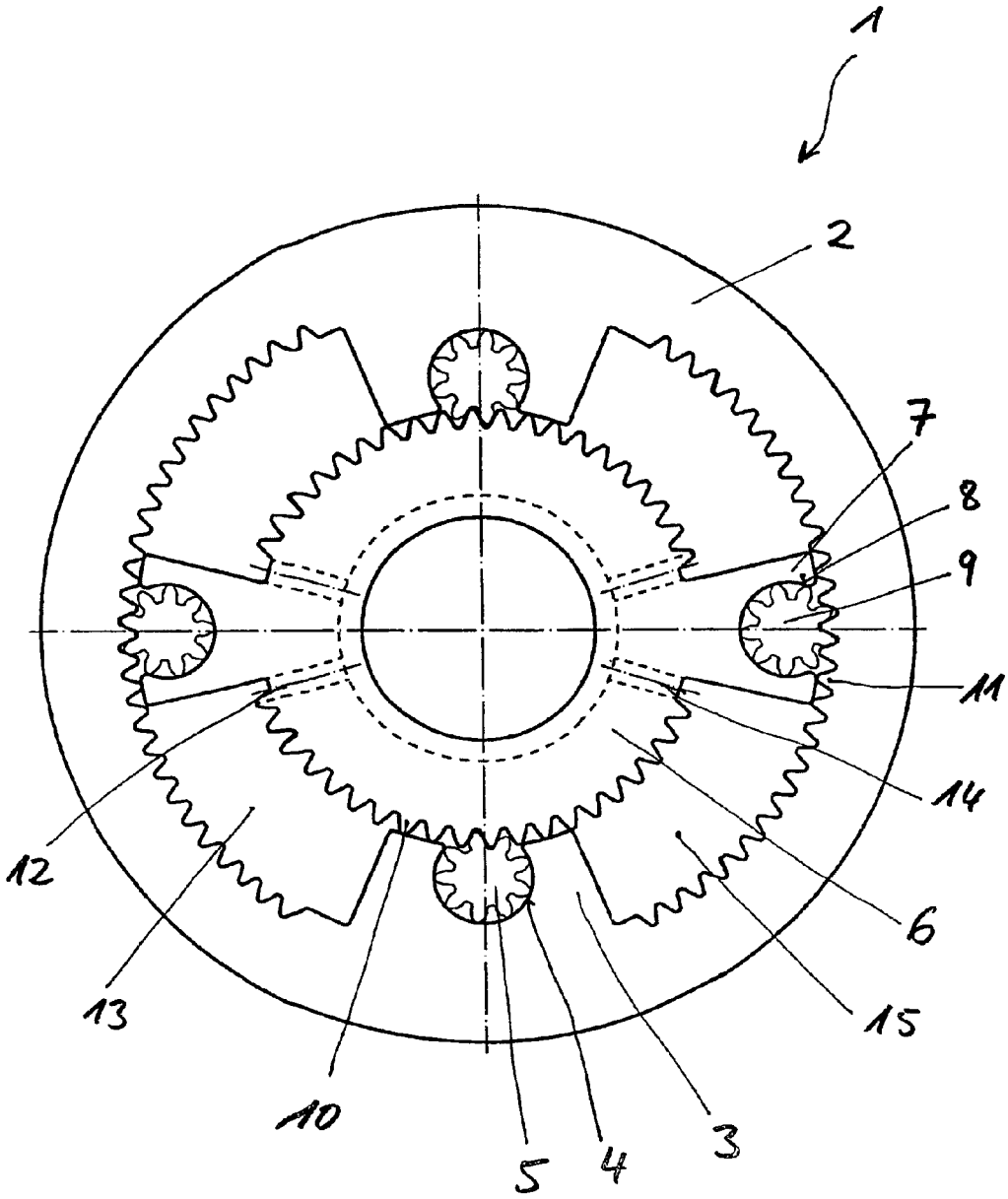
FIG. 3, a section through the camshaft adjuster according to the invention and comprising two stator and rotor vanes.

FIG. 3 shows a camshaft adjuster 1 for an unrepresented internal combustion engine and with a stator 2 which comprises, distributed over its periphery, stator vanes 3 projecting inwards in the radial direction. Each of the stator vanes 3 comprises a mounting pocket 4 which is open in the inward direction and in which a stator vane planet gear 5 is mounted. Mounted in the stator 2 is a rotor 6 which comprises rotor vanes 7. Each rotor vane 7 comprises a mounting pocket 8 which is open in the outwards direction and in which a rotor vane planet gear 9 is mounted. Each of the stator vanes 3 projects inwards in the radial direction into the spaces between the two rotor vanes 7. The same holds for the rotor vanes 7, each of which projects cleanly into the intervening space. Thus it follows that the rotor 6 is formed to have approximately the form of a star. The stator vane planet gear 5 disposed in the stator vane 3 meshes with a denticulated segment 10 disposed on the outer periphery of the rotor 6 between each pair of rotor vanes 7. The rotor vane planet gear 9 disposed in the rotor vane 7 meshes with a denticulated segment 11 disposed on the inner periphery of the stator 2 between each pair of stator vanes 3. Internal radial leakages, which arise between the contact points of the stator 2 and the inner rotor 6 in the form of gap losses, are prevented by the use of the denticulated segment and the planet gears meshing with them. The adjustment of the rotor 6 is done by pressure in the pressure chamber 13 being increased through the pressure hole 12, or, for the alternative direction of turning, pressure being increased in the pressure chamber 15. Depending on the pressure chamber 13, 15 pressurized, the pressure is against the rotor vane 7, whereby it is turned accordingly. The stator vane planet gear 5, which meshes with the denticulated segment 10 of the rotor 6, is pressurized by the oil pressure in the pressure chamber 13 or 15, where, due to the pressurization, the tooth points of the stator vane planet gear 5 are pressed against the wall of the mounting pocket 4 in the stator vane and the tooth flanks of the stator vane planet gear 5 are pressed against the tooth flanks of the denticulated segment 10 of the rotor 6. Due to the pressing of the tooth points and the tooth flanks, large sealing surfaces arise, which separate the pressure chambers 13, 15 in the radial direction absolutely tightly from the corresponding pressureless chamber 13, 15 so that a radial sealing of the camshaft adjuster 1 is enabled. Due to the fact that the camshaft adjuster 1 in FIG. 3 comprises only two stator vanes 3 and two rotor vanes 7, through this reduction in the number of stator vanes and rotor vanes from four vanes 3, 7 to two vanes, it is achieved that, on the one hand, larger turning angles can be realized and, on the other hand, the camshaft adjusters become lighter and there is a smaller mass for moving parts. In addition the friction is reduced since at the same time fewer planet gears mesh in the corresponding denticulated segments.

We claim:

1. A camshaft adjuster for an internal combustion engine and with a stator which comprises, distributed over its periphery, stator vanes projecting inwards in the radial direction which comprise at least one mounting pocket which is disposed in the stator and is open in the inward direction and in which a stator vane planet gear is mounted, where, mounted in the stator, there is a rotor which comprises rotor vanes with at least one mounting pocket which is open in the outwards direction and in which a rotor vane planet gear is mounted, where the stator vane planet gear meshes with a denticulated segment disposed on the outer periphery of the rotor between each pair of rotor vanes and the rotor vane planet gear meshes with a denticulated segment disposed on the inner periphery of the stator between each pair of stator vanes.

2. A camshaft adjuster for an internal combustion engine and according to claim 1, characterized by the fact that the stator comprises at least two stator vanes and the rotor comprises at least two rotor vanes.

3. A camshaft adjuster for an internal combustion engine and according to claim 1, characterized by the fact that the stator comprises three stator vanes and the rotor comprises three rotor vanes.

4. A camshaft adjuster for an internal combustion engine and according to claim 1, characterized by the fact that the stator comprises four stator vanes and the rotor comprises four rotor vanes.

5. A camshaft adjuster according to one of claims 1, characterized by the fact that the stator, the rotor, and/or the planet gears consist of sintered metal.

6. A camshaft adjuster according to one of claims 1, characterized by the fact that the stator, the rotor, and/or the planet gears consist of plastic.

7. A camshaft adjuster according to claim 1, characterized by the fact that the stator, the rotor, and/or the planet gears have at least approximately equal coefficients of thermal expansion.

* * * * *